United States Patent [19]

Trombetti, Jr.

[11] 4,366,930

[45] Jan. 4, 1983

[54] TABLET PULVERIZER

[76] Inventor: Albert V. Trombetti, Jr., 23 Richland Rd., Cranston, R.I. 02910

[21] Appl. No.: 257,637

[22] Filed: Apr. 27, 1981

[51] Int. Cl.[3] ..... B02C 1/00; B02C 19/12

[52] U.S. Cl. ..... 241/169; 241/169.1; 241/199.12; 241/DIG. 27

[58] Field of Search ..... 241/168, 169.1, 169.2, 241/199.11, 199.12, 205, 95, 100, DIG. 27, 89.3, 89.4

[56] References Cited

U.S. PATENT DOCUMENTS

| | | | |
|---|---|---|---|
| 75,913 | 3/1868 | Hollingsworth | 241/264 |
| 1,903,527 | 4/1933 | Barnhisel | 241/89.3 |
| 2,161,998 | 6/1939 | Chott | 241/DIG. 27 X |
| 2,572,378 | 10/1951 | Paul . | |
| 2,602,596 | 7/1952 | Jones et al. . | |
| 2,631,786 | 3/1953 | Morgan et al. . | |
| 2,726,816 | 12/1955 | Brantley . | |
| 2,892,595 | 11/1954 | Tupper . | |
| 3,552,460 | 1/1971 | Cooney | 241/169.1 |
| 3,773,468 | 11/1973 | Hubbard et al. | 241/DIG. 27 X |
| 4,121,775 | 10/1978 | Roseberg et al. | 241/30 |
| 4,212,430 | 7/1980 | Dale et al. | 241/100 X |

*Primary Examiner*—Mark Rosenbaum
*Assistant Examiner*—Timothy V. Eley
*Attorney, Agent, or Firm*—Salter & Michaelson

[57] ABSTRACT

A table pulverizer for crushing solid tablets into powder is disclosed. The tablet pulverizer is hand-operated and includes a tubular body portion having a screen located therein for receiving the solid tablets thereon. An elongated axially movable crusher member extends into the body portion and is axially and rotatably movable to crush the solid tablets into powder form. A bottom container that is mounted on the tubular body portion at the lower end thereof receives the powder as it is filtered through the screen, the container being removable from the body portion for dispensing of the powder as required.

4 Claims, 6 Drawing Figures

TABLET PULVERIZER

BACKGROUND OF THE INVENTION

The present invention relates to a tablet crusher and more particularly is utilized to crush pills and other consummable tablets into powdered form so that the powder may be dissolved in liquid for easy consumption as required.

Some individuals who are required to take medication or some form of a tablet have difficulty in swallowing the tablet in whole form. Such individuals have usually resorted to the manual crushing of the tablet into particle or powder form, whereafter the powdered tablet is dissolved in liquid which can then be more easily swallowed. Some medications are actually manufactured by the tablet maker in liquid or powdered form, but this form of medication is not usually found in most types of medicinal products, and the individual requiring medication that is only available in tablet form has to resort to crushing the tablet if it cannot be consumed in whole form.

Prior to the instant invention, some efforts have been made to provide tablet crushers of the portable type for pulverizing tablets, pills or the like; and examples of this type of device are illustrated in the U.S. Patent to Jones et al, U.S. Pat. No. 2,602,596 and Tupper, U.S. Pat. No. 2,892,595. Both of the referred to patents include a receptacle of some kind in which a tablet or pill is received, a crushing member being insertable into the container for a rotating or grinding movement to crush the tablet into powder form within the container. In U.S. Pat. No. 2,602,596, the lowermost end of the crushing member is provided with a concave protuberance that engages the pills for crushing them into a suitable recess as formed in a lower cap member. In U.S. Pat. No. 2,892,595 the conical container as illustrated receives the tablets therein, and a correspondingly formed crushing member is received within the conical container and rotated to perform the grinding or pulverizing of the tablets.

Although these prior known constructions as illustrated in the above-referred to patents performed the function of grinding the tablets into powdered form to some degree, a complete grinding of the tablets was not always effected. In use of such devices, some larger particles would always remain unground after the initial grinding operation, and additional grinding movements of these prior known tablet crushers was required to effect a more complete grinding of the tablet for consumption by the user, and even then some portions of the tablet would not be completely reduced to powder form. Further, the construction of the pulverizing device as illustrated in the above-referred to patents was not easy to manipulate and considerable effort had to be exerted by the user to produce a completely ground tablet.

The present invention as will be described hereinafter avoids the attendant difficulties as experienced in the prior known tablet crushing devices and represents a unique and useful tablet pulverizer that is simple to use and economical to manufacture.

Other references of which applicant is also aware, that when combined with the above-referred to patents represent the best prior art known to applicant to which the subject invention pertains, are: U.S. Patents to Hollingsworth et al, U.S. Pat. No. 75,913; Paul, U.S. Pat. No. 2,572,378; Morgan, U.S. Pat. No. 2,631,786; Brantley, U.S. Pat. No. 2,726,816 and Roseberg et al, U.S. Pat. No. 4,121,775.

SUMMARY OF THE INVENTION

The present invention relates to a hand-operated tablet pulverizer for crushing solid tablets into powder and includes a tubular body portion having a screen located therein adjacent to the bottom thereof, the tablets to be crushed being received in said body portion and in engagement with the screen. A botton container is removably mounted on the lowermost end of the body portion, the interior of the bottom container being disposed directly beneath the screen. An elongated axially movable crusher member extends into the body portion, the lowermost end of the crusher member being movable into engagement with the tablets as located on the screen. A cap member engages the upper end of the crusher member and defines the top of the pulverizer, the cap member being movable axially with the crusher member to urge the lower end of the crusher member into intimate contact with the tablets and being rotatable to cause said crusher members' lower end to produce a grinding action on the tablets, wherein the tablets are ground into powder, the powder filtering through the screen for collection in the bottom container.

Accordingly, it is an object of the present invention to provide a tablet pulverizer that provides for the crushing of solid tablets into powder form and that enables the powder to be easily removed from the pulverizer for the dispensing thereof as required. p Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
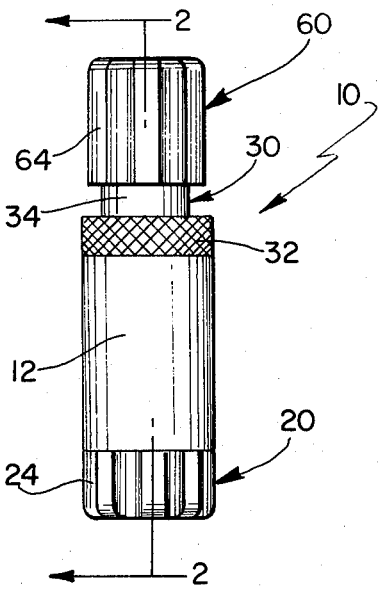
FIG. 1 is an elevational view of the tablet pulverizer as embodied in the present invention.
Figure 6:
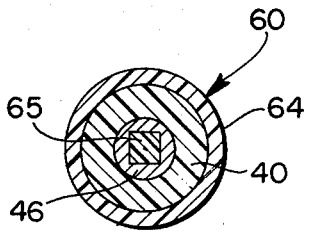
FIG. 6 is a sectional view taken along line 6—6 in FIG. 2.

Referring now to the drawing, the tablet pulverizer embodied in the present invention is illustrated and is generally indicated at 10. The tablet pulverizer 10 is relatively small in dimension and is adaptable for carrying by the user in a pocket or purse and is further of a convenient size to be hand-operated for crushing a tablet into powder form.

The tablet pulverizer 10 includes a cylindrical or tubular body portion 12 that is preferably molded of a thermosetting plastic material; and as will be described hereinafter, substantially all of the other components of the pulverizer are also formed of a suitable thermosetting plastic material. However, it is understood that other materials such as wood or metal could be utilized without departing from the spirit of the invention.

Figure 4:
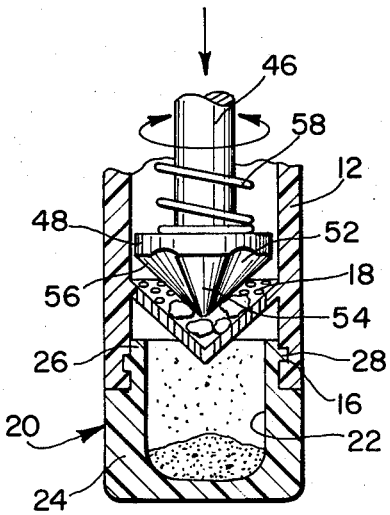
FIG.4 is a sectional view of the bottom portion of the tablet pulverizer and illustrates the action of the crusher member during the pulverizing action.
Figure 5:
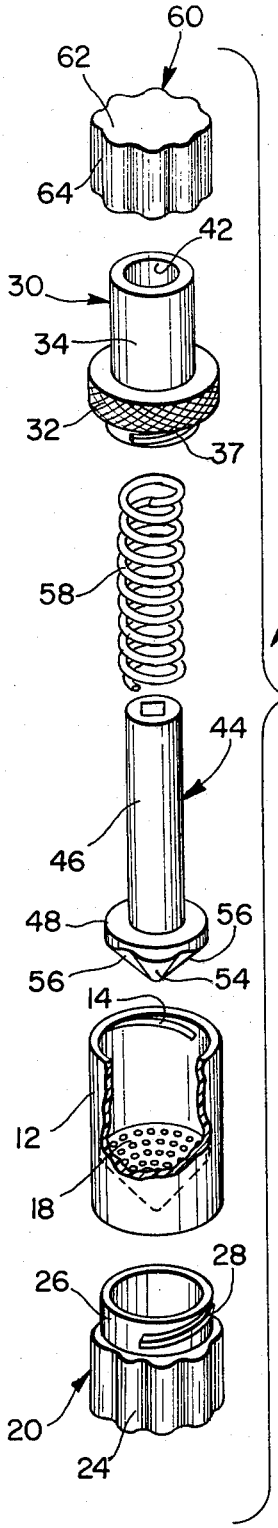
FIG. 5 is an exploded perspective view of the tablet pulverizer showing the various components thereof.

As more clearly illustrated in FIGS. 2–5, the tubular body portion 12 is formed with an upper internally threaded portion 14 and a lower internally threaded portion 16, which as will be described hereinafter receive other components of the pulverizer in threaded relation therein. Formed as an integral part of the body portion 12 and located adjacent to the lowermost end thereof is a screen 18 that has a downwardly directed conical configuration. As illustrated in FIG. 5, the screen 18 is formed with a plurality of small diameter openings that provide for the filtering of minutely sized particles of crushed powder therethrough. As will be more fully described hereinafter, the screen 18 prevents larger particles from passing therethrough until such larger particles have been sufficiently crushed into the minutely sized particles to enable these smaller particles to pass through the openings in the screen.

Figure 2:
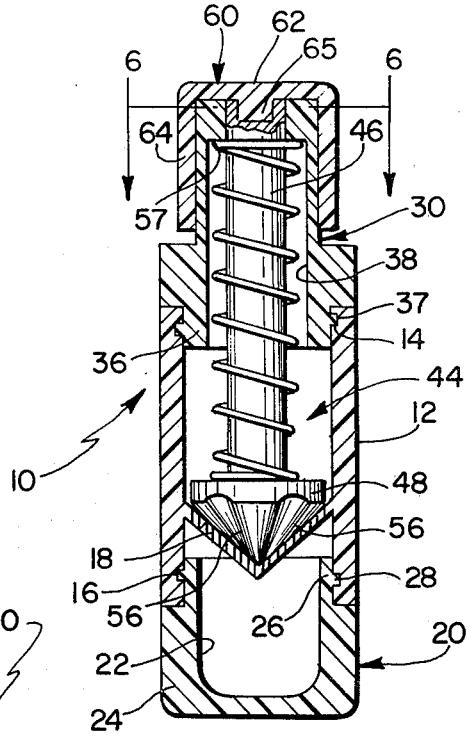
FIG. 2 is a sectional view taken along line 2—2 in FIG. 1.
Figure 3:
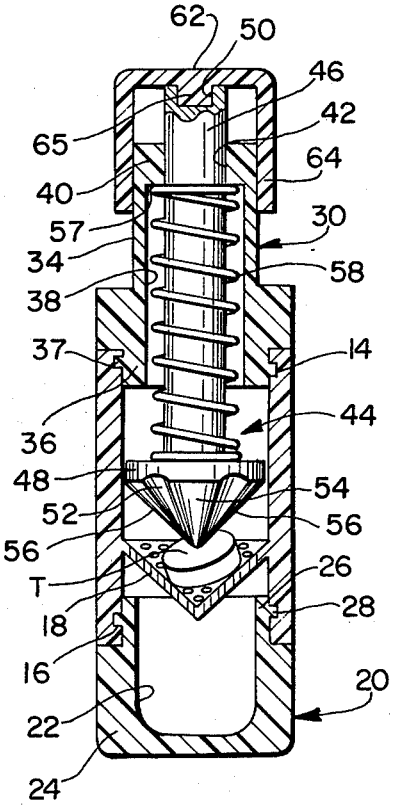
FIG. 3 is a view similar to FIG. 2 and shows a tablet as disposed in the body portion of the pulverizer prior to the crushing thereof.

Mounted on the bottommost end of the pulverizer 10 is a container generally indicated at 20 that is formed with an interior cavity 22. The exterior portion of the container 20 is formed with a knurled area 24 that enables the container to be gripped by the user for mounting the container 20 on the body portion 12 or removing it therefrom as required. Extending upwardly from the knurled portion is a reduced neck 26 on which an externally threaded portion 27 is formed. As illustrated in FIGS. 2, 3 and 4, the neck 26 is dimensioned to snugly fit within the interior of the tubular portion 12, the threaded portion 27 cooperating with the threaded portion 16 for securing the container 20 to the bottommost end of the tubular portion 12. It is also seen that the knurled portion 24 has a diameter that is substantially the same as the exterior diameter of the tubular portion 12 and forms substantially a continuation thereof. As further illustrated in FIGS. 2–4, the cavity 22 of the container 20 is located directly beneath the screen 18; and upon the pulverizing of a tablet, the powdered material that filters through the screen 18 falls within the cavity 22 for collection therein.

Joined to the uppermost end of the tubular portion 12 is a sleeve generally indicated at 30 that is defined by a lower sleeve portion 32 and an upper sleeve portion 34 that has a diameter that is reduced with respect to the diameter of the lower sleeve portion 32. Formed on the lower sleeve portion 32 is a lower neck section 36 that has an externally threaded portion 37 formed thereon, the threaded portion 38 cooperating with the internal threaded portion 14 for mounting the sleeve 30 on the tubular portion 12. Extending through the lower sleeve portion 32 and for a substantial length of the upper sleeve portion 34 is an interior bore 38. The uppermost end of the upper sleeve portion 34 indicated at 40 also has a bore 42 formed therein that is a continuation of the bore 38 but is of reduced diameter with respect thereto. As further shown in FIG. 5, the exterior of the lower sleeve portion 32 is formed with a roughened or knurled-type surface to promote the gripping thereof when the sleeve 30 is removed from the assembly.

Extending through the bores 38 and 42 and projecting into the interior of the tubular portion 12 is a crusher member generally indicated at 44 that includes an elongated shank portion 46 and a lower arrow-shaped crusher element 48. The shank portion 46 of the crusher member 44 has a diameter that freely fits within the bore 38 but that slidably fits within the bore 42, the uppermost end of the shank portion 46 being formed with a noncircular recess 50 that is preferably square in configuration. The lowermost end of the crusher member 44 which is defined by the crusher element 48 has an inverted conical configuration, the shape of which corresponds to that of the screen 18, wherein the screen 18 receives the crusher element 48 therein in snug-fitting relation as more clearly shown in FIG. 2. The crusher element 48 is also formed with a plurality of downwardly diverging grooves 52, which define surfaces 54 therebetween, edges 56 being created by the grooves 52 and the surfaces 54 and providing grinding edges for crushing and pulverizing tablets as will be described hereinafter. It is also seen that the upper portion of the crusher element 48 has a diameter that is slightly less than the interior diameter of the tubular portion 12 that permits unobstructed rotation and movements of the crusher element 48 within the tubular portion 12.

As also illustrated in FIGS. 2 and 3, a compression spring 58 is located in surrounding relation with respect to the shank portion 46 of the crusher member 44 and extends from the upper surface of the crusher element 48 to a shoulder 57 as formed by the junction of the upper sleeve portion 34 and the upper portion 40 thereof. Thus, the crusher member 44 is located such that the crusher element 48 thereof is normally disposed in the lowermost position thereof as shown in FIG. 2, the spring 58 urging the crusher member to the lowermost position.

Located at the uppermost end of the pulverizer 10 and defining the top thereof is a cap member generally indicated at 60 that is defined by an upper wall 62 and an annular side wall 64, the surface of which is formed with a knurled configuration for facilitating the gripping thereof. As shown in FIGS. 2 and 3, the cap member 60 is open at the bottom end thereof for receiving the upper sleeve portion 34 and the top portion 40 thereof in sliding relation. Joined to the interior of the upper wall 62 and formed as an integral part thereof is a projection 65 that has a noncircular configuration, preferably square, and that corresponds to the configuration of the recess 50 as formed in the topmost end of the shank portion 46. The projection 65 is frictionally received within the recess 50 to secure the cap member 60 to the shank portion 46 of the crusher member 44 so that upon rotation of the cap member 60 and the application of a downwardly directed force thereon, the crusher element 48 is moved downwardly within the tubular portion 12 and rotated therein during a pulverizing or crushing action of a tablet. It is also seen that the spring 58 normally urges the crusher member 44 downwardly and that if a tablet is located on the screen 18 in the tubular portion 12, the spring 58 will urge the crusher member 44 into engagement with the tablet.

In use of the tablet pulverizer 10, the user removes the assembly defined by the sleeve 30, crusher member 44 and cap 60 by rotating the lower sleeve portion 32 relative to the tubular portion 12. With the crusher member 44 removed from the interior of the tubular portion 12, a tablet indicated at (T) is placed on the screen 18 and the assembly as described is then remounted on the tubular portion 12 by screwing the lower sleeve portion 32 thereon. The user then exerts a downward thrust on the cap member 60 and simultaneously rotates the cap member 60 or moves the cap member in a counterclockwise-clockwise movement as seen in FIG. 4. This action, which produces a back-and-forth rotating movement of the crusher element 48, causes the edges 56 thereof to effect a grinding or pulverizing action on the tablet (T) as located on the screen 18. As the tablet (T) is crushed and pulverized, the particles that are produced by the pulverizing action will filter through the openings in the screen into the cavity 22 of the container 20. Only those particles that are small enough to filter through the small diameter openings in the screen 18 will be received within the cavity 22, and a continued grinding action of the crusher element 48 on the tablet particles will eventually reduce the tablet to a powder form that will enable all of the particles thereof to pass through the screen openings into the cavity 22 of the container 20. Upon completion of the grinding and pulverizing action, the user then removes the container 20 from the bottom of the tubular portion 12 by a twisting action thereof. The tablet powder as collected in the container 20 is then poured into a glass of water or received in a spoon for dissolving and consumption as required.

It is seen that the hand-operated tablet pulverizer of the subject invention is conveniently utilized whenever it is necessary to grind a tablet into powder form. If desired, one or more tablets may be stored in the container 20 when the device is carried on the person of the user, and thereafter removed for insertion on the screen 18 of the tubular portion 12 as described hereinabove. The various components of the pulverizer are easily and economically manufactured, and the device is simple in operation and relatively free of any maintenance problems.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hand-operated tablet pulverizer for crushing solid tablets into powder, comprising a tubular body portion having a screen located therein adjacent to the bottom thereof, said tablets to be crushed being received in said body portion and in engagement with said screen, said screen having a plurality of small diameter openings formed therein and being molded in a one-piece construction to the interior of said tubular body portion, said screen having an inverted conical configuration that defines a pocket for receiving said tablets therein, a bottom container removably mounted on the lowermost end of said body portion, the interior of said bottom container being disposed directly beneath said screen, an elongated axially movable crusher member extending into said body portion, the lowermost end of said crusher member being movable into engaging relation with said tablets as located on said screen, a cap member engaging the upper end of said crusher member and defining the top of said pulverizer, said cap member being movable axially with said crusher member to urge the lower end of said crusher member into intimate contact with said tablets and being rotatable to cause said lower end to produce a grinding action on said tablets, wherein said tablets are ground into powder, the powder filtering through said screen for collection in said bottom container, said crusher member including an elongated shank portion, a spring surrounding said shank portion for a major portion of the length thereof, and engaging said crusher member for normally urging the lower end thereof into engagement with the tablets as located in the screen pocket, a sleeve mounted on said tubular body portion and surrounding said shank portion and a portion of said spring, said sleeve receiving the uppermost end of the spring in abutting relation thereagainst, wherein a downward thrust is exerted on said crusher member, the uppermost end of said sleeve having an opening formed therein through which the uppermost end of said shank portion extends, wherein said cap member is received on said shank portion for movement therewith, said cap member being slidably received on said sleeve for being movable in the axial and rotatable motion thereof with said crusher member during a crushing and grinding action of said tablets.

2. A hand-operated tablet pulverizer as claimed in claim 1, the uppermost end of said shank portion that extends through said opening terminating above the uppermost end of said sleeve and having a noncircular recess formed therein, means secured to said cap and having a configuration corresponding to that of said recess for being received in said recess for securing said cap member to said crusher member, wherein rotation and axial movement of said cap member produces a corresponding movement of said crusher member.

3. A hand-operated tablet pulverizer as claimed in claim 2, said sleeve including a lower neck section that extends into the upper end of said body portion and is threadably secured therein.

4. A hand-operated tablet pulverizer as claimed in claim 1, said conical lower end of said crusher member having an external surface that is formed with spaced inclined grooves, said grooves defining a plurality of inclined edges that promote the crushing and grinding of said tablets as said crusher member is moved axially and rotated within said tubular body portion.

* * * * *